US005476216A

United States Patent [19]

Robertella et al.

[11] Patent Number: 5,476,216

[45] Date of Patent: Dec. 19, 1995

[54] RESTRAINABLE DISPOSABALE BOX

[76] Inventors: Richard Robertella, 217 Fairview Ave., Verona, N.J. 07044; Eustathios Vassiliou, 12 S. Townview Ln., Newark, Del. 19711

[21] Appl. No.: 267,118

[22] Filed: Jun. 27, 1994

[51] Int. Cl.[6] ..... B65O 5/42

[52] U.S. Cl. ..... 229/117.01; 229/109; 229/125.38; 229/906; 229/939

[58] Field of Search ..... 229/109, 110, 229/117.01, 125.37, 125.38, 125.39, 902, 906, 939; 5/417; 431/125; 493/462

[56] References Cited

U.S. PATENT DOCUMENTS

| | | | |
|---|---|---|---|
| 664,835 | 1/1901 | Czarniecki | 229/117.01 |
| 705,953 | 7/1902 | Neihysel | 229/125.38 |
| 1,135,117 | 4/1915 | Lafore | 229/125.38 |
| 1,408,814 | 3/1922 | List | 229/149 |
| 2,013,646 | 9/1935 | Andrews | 229/125.38 |
| 2,037,675 | 4/1936 | Boothby et al. | 229/117.01 |
| 2,189,436 | 7/1938 | Rosenfield | 229/4.5 |
| 2,244,940 | 6/1941 | Carruth | 229/5.5 |
| 2,671,593 | 3/1954 | Page | 229/5.7 |
| 2,732,063 | 1/1956 | Dedek et al. | 493/462 |
| 2,807,405 | 9/1957 | Lambert | 229/41 |
| 2,845,976 | 8/1958 | Miller | 150/52 |
| 3,180,555 | 4/1965 | Barrett | 229/117.01 |
| 3,355,087 | 11/1967 | Turnbull, IV | 229/125.28 |
| 3,473,723 | 10/1969 | Bolling, Jr. et al. | 229/117.01 |
| 4,228,918 | 10/1980 | Kellogg | 221/65 |
| 4,365,738 | 12/1982 | Densen | 229/117.01 |
| 4,402,452 | 9/1983 | Kupersmit | 229/117.01 |
| 4,623,324 | 11/1986 | Zulkowitz | 493/462 |
| 4,815,155 | 3/1989 | Sommers | 5/417 |
| 4,967,986 | 11/1990 | Schildkraut | 5/417 |
| 5,040,721 | 8/1991 | Essak | 229/112 |
| 5,110,038 | 5/1992 | Pantisano | 229/103 |
| 5,197,659 | 3/1993 | Vassiliou | 229/117.01 |
| 5,273,206 | 12/1993 | Vassiliou | 229/117.01 |

FOREIGN PATENT DOCUMENTS

| | | | |
|---|---|---|---|
| 1302573 | 7/1962 | France | 229/117.05 |
| 4316605 | 12/1993 | Germany | 229/117.01 |
| 374970 | 6/1932 | United Kingdom | 229/117.01 |

*Primary Examiner*—Gary E. Elkins
*Attorney, Agent, or Firm*—E. Vassiliou

[57] ABSTRACT

A box of the type to hold pies, such as pizza pies, which comprises a basic cardboard structure and a restrainer in an inactive form. When the box has been used for its purpose and it is time to be disposed of, the box is destructively folded into a log-shaped structure, which is prevented from spontaneously unfolding by activation of the restrainer.

12 Claims, 8 Drawing Sheets

RESTRAINABLE DISPOSABALE BOX

FIELD OF THE INVENTION

This invention relates to cardboard boxes, cartons or containers adaptable to contain flat food products, such as pies and pizzas. More particularly it relates to boxes which may be easily disposed of by destructive folding.

BACKGROUND OF THE INVENTION

There is a plethora of box types existing in the marketplace, such as for example those with small or large dimensions, re-usable or disposable, thin or thick, composite or single-ply structured, rigid or flexible, foldable or non-foldable, and the like.

In order to reduce cost of manufacturing, transportation, manipulation by a middle- or end-user, as well as other costs, foldable boxes are becoming increasingly popular. For the same reasons, monolithic (one piece) unfolded boxes containing primary folding lines are provided to retailers, who fold them on demand to enclose an item to be sold to the consumer.

Some of these boxes are easy to dispose of, because they may be either small, or flexible, and the like. However, there is a category of boxes, which have large and/or awkward dimensions and high rigidity, with large flat segments both before and after the box formation, which present considerable difficulty in bending and destructive folding for disposal. A representative type of such boxes, which are difficult to discard, are the pizza boxes. These boxes come usually in a monolithic form to the pizza-House or establishment, and they are folded around primary folding lines to form boxes having very large flat segments. These boxes are of different shapes, such as for example square, hexagonal, octagonal, and the like. The primary folding lines may be perforations, indentations, slits, cuts, or any other weakening lines, or configurations, very well known to the art of box formation. These lines provide weakening of the integrity of the unfolded box (blank) along their length, so that the unfolded box (blank) can be shaped around the weakening lines.

U.S. Pat. Nos. 2,189,436 (Rosenfield), 2,244,940 (Carruth), 2,671,593 (Page), 2,807,405 (Lambert), and 4,228,918 (Kellogg), disclose boxes which are characterized by a large multiplicity of primary fold lines which are positioned in a way to form substantially curved configurations, like for example substantially circular side wall structures.

U.S. Pat. No. 2,845,976 (Miller) discloses a collapsible roll-up container with a series of flat members each formed with a tendency to coil. The spring structure of this box, however, is expensive to make and it does not provide adequate rigidity for end-uses such as pizza boxes, and the like.

U.S. Pat. No. 5,040,721 (Essak) discloses a collapsible box with a stiffening insert.

U.S. Pat. No. 5,110,038 (Pantisano) discloses a standard corrugated pizza box which is provided with slit-cuts cut through the top panel of the pizza box in a shape to cut off four circular serving plates with a beveled raised edge and two cross-slit cuts through the bottom panel of the pizza box separating the pizza box into four essentially equal portions for disposal. Pantisano's arrangement is based on tearing the box apart.

U.S. Pat. Nos. 664,835 (Czarniecki), 2,037,675 (Boothby et al.), 3,473,723 (Bolling, Jr. et al) and 4,365,738 (Densen), as well as French Patent 1,302,573 show various collapsible boxes.

U.S. Pat. Nos. 5,197,659 (Vassiliou) and 5,273,206 (Vassiliou) disclose boxes, which are incorporated herein by reference, may be discarded by destructive folding. However, even these boxes have a tendency to unfold after the destructive folding, and attain higher volume than necessary.

None of the above references or any other reference known to Applicants disclose, mention or suggest a restrainable foldable box as described and claimed hereinbelow.

SUMMARY OF THE INVENTION

The instant invention is directed to foldable boxes, and more particularly to boxes which may be easily disposed of by destructive folding and restraining. In summary, the invention pertains a box of the type employed to contain a pizza comprising:

a basic cardboard box structure; and a restrainer in an inactive status, the restrainer being adaptable to assist the cardboard box structure in retaining a folded position after said cardboard box structure has been used to hold an item of of the type of pizza, has been folded to form a log-shaped structure in order to be discarded, and the restrainer has been activated.

The restrainer may be an integral part of the cardboard box structure, which preferably comprises an opening on the cardboard box structure and an extension adaptable to fit in the opening. The opening is preferably a latent opening when the cardboard box structure is in an unfolded mode. It is also preferable that the cardboard box structure further comprises latent folding lines, the latent lines arranged at such intervals from each other, so that when the cardboard box structure is folded around said latent lines, said cardboard box structure allows the restrainer to be activated by positioning the extension into the opening.

It is preferable that the latent opening is connected to a latent destructive line. It is even more preferable that the latent opening forms a tongue on a side of the opening away from the front end of the box structure, when the box is destructively folded to the log-shaped structure.

The restrainer may also be a separate element attached to the cardboard box structure. In this case, the restrainer may preferably comprise an element selected from a group consisting of band, elastic band, string, cord, strap, tie, ribbon, strand, thread, tape, wire, and a combination thereof.

The cardboard box structure may have two major flat portions comprising a top and a bottom, an inside surface and an outside surface, a front end, a back end, and two side-sections, wherein the cardboard box structure is adapted to be destructively foldable from the back end toward the front end, and the restrainer is attached on the outer surface of the top.

In the case that the restrainer is attached as a separate element on the cardboard structure, it is preferred that said restrainer is positioned within 8 inches from the front end, and more preferred that the restrainer is a rubber band positioned within 5 inches from one of the side sections.

The restrainer may also be detached from said box structure when the restrainer is in the inactive status, but in restraining contact with the box when the restrainer is in the active status.

This invention also pertains to a method of discarding a used box of the type employed to contain a an item of the type of a pizza, the box comprising a basic cardboard structure, the method comprising the steps of:

folding the used box to attain a log shape;

activating a restrainer to the used box in a manner that the box resists unfolding; and discarding the restrained log-shaped box.

The box may have corrugations, and the folding of the box may be conducted against said corrugations.

The present invention further pertains to an assembly of a box and an item of the type of a pizza contained in the box, the box comprising:

a cardboard box structure; and a restrainer in an inactive status, the restrainer being adaptable to assist the box structure in retaining a folded position after the box has been used to hold an item of the type of a pizza, has been folded to form a log-shaped structure in order to be discarded, and after the restrainer has been activated.

The restrainer may be attached to the cardboard box structure, or the restrainer may be detached from said box structure when the restrainer is in the inactive status, but in restraining contact with the box when the restrainer is in the active status.

DESCRIPTION OF THE DRAWING

The reader's understanding of the present invention will be enhanced by reference to the following detailed description taken in conjunction with the drawing figures, wherein.

DETAILED DESCRIPTION OF THE INVENTION

Figure 1:
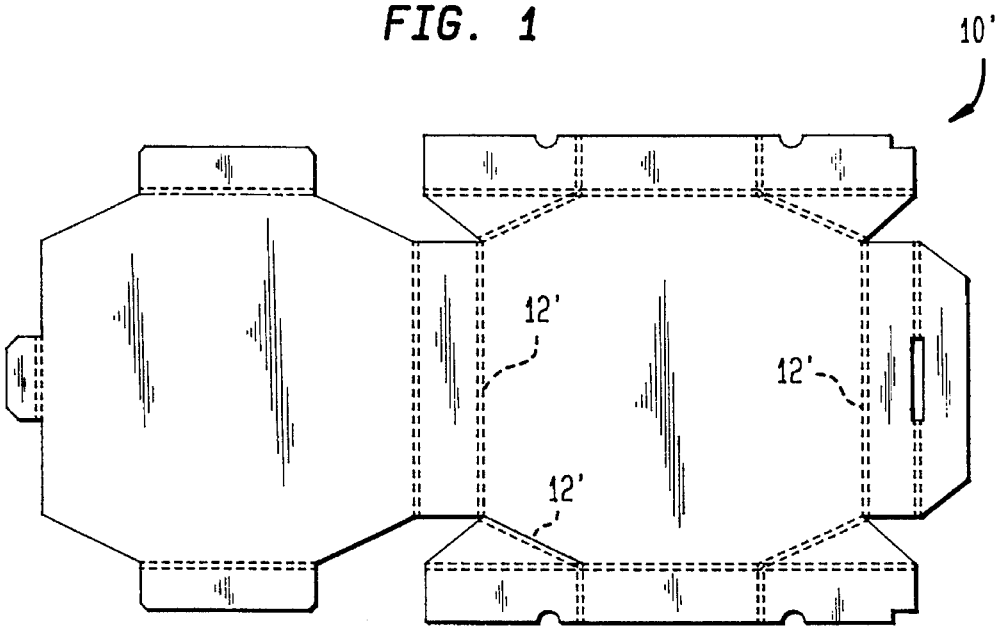
FIG. 1 is a schematic diagram showing a box blank of the prior art.

The instant invention is directed to foldable boxes, and more particularly to boxes which may be easily disposed of by destructive folding, preferably to form a log-shaped configuration resisting unfolding.

It is important at this point to define certain terms used to describe this invention. By "foldable box" it is meant a box which takes its shape by folding different sections of a "box-blank" or "blank", or in other words a blank piece of flat material, such as cardboard for example, around folding lines, called "primary folding lines" in this discussion. This action is also called "formation" of the box. "Unfolded box" or "Unfolded box-blank" have the same meaning and they refer to a blank piece of flat material as mentioned above. In the same manner, "folded box" and "folded box-blank" have also the same meaning and they refer to the shaped article after folding the miscellaneous segments around the "primary folding lines". The primary folding lines may include indentations, miscellaneous cuts, through-cut slits, perforations, scores, and the like, well known to the art. For all practical purposes, the term "perforation" includes miscellaneous types of through-cuts and through-cut slits. The primary folding lines have a maximum possible degree of weakening the box at their location, so that an operator may perform the folding as fast and as easily as possible, with a minimum chance of misfolding the box in the wrong place. Thus, the box may be folded, unfolded, and re-folded at will many times around the "primary folding lines" without any substantial loss of its final integrity as a folded or formed box. Score lines may also be used for this purpose, mainly on the outside surface of the unfolded box or blank, so that segments of the box may be bent and folded over the length of the primary folding lines. However, these score lines are purposely designed to be as wide and deep as possible in order to yield to a folding or bending force, usually toward the inside of the box, as easily as possible, for the same reasons described above.

There is another type of lines which are perpendicular to the longitude of the box-blank and parallel to each other, as explained in U.S. Pat. Nos. 5,197,659, and 5,273,606, both of which are incorporated by reference herein. These lines are called "Latent Destructive Lines", and have higher resistance to folding than the primary folding lines. Once the Latent Destructive Lines have yielded, they bring about permanent destruction or damage to the integrity of the folded or unfolded box or box-blank as defined above. One can control the degree of resistance to yielding to folding or bending forces by varying the width, the depth, and the frequency of indentations or scores, or the dimensions and frequency of perforations, and the like, as explained in U.S. Pat. Nos. 5,197,659, and 5,273,606 in detail. The wider, the deeper and more frequent the indentations and/or the scores, as well as the larger the dimensions and the more frequent the perforations the more easily the lines will yield to folding or bending forces. Thus, it is very easy for a person of ordinary skill in the art to determine with very little experimentation a degree of resistance so that the latent destructive lines will not yield or present interference with the formation of the box. At the same time, after the useful life or function of the box has been ceased, an operator may destructively fold the box from one end toward the other end around the latent destructive lines in a manner that the box forms a log-like structure. The destructively folded or rolled box is considerably less bulky than the intact box, and it may be more easily disposed as compared to the original intact box.

One disadvantage, however, of the methods resulting in destructively folding or rolling the bulky box for disposal, is the fact that the destructively folded or rolled box has a tendency to be spontaneously unfolded to a certain degree, and although it is still considerably less bulky than the original intact box, it is notably bulkier than the completely destructively folded box.

This invention provides a box for flat items, such as a pizza, which after having been completely destructively folded, resists spontaneous unfolding, and reduces considerably the bulkiness of the disposed of destructively folded box. By the term "completely destructively folded", it is meant "destructively folded to the degree that any particular operator was able to achieve at that particular instance".

Although this invention preferably applies to log-shaped destructively folded boxes as the ones disclosed in U.S. Pat. Nos. 5,197,659, and 5,273,606, it also applies to any other type of destructively folded pizza boxes into a log-shape, regardless of the method used to achieve the folding, and in the presence or absence of destructive lines. In the absence of latent destructive lines of any sort, the operator has to have higher skill and strength to fold the box against its corrugation than in the case of the presence of such latent destructive lines. In addition, the boxes destructively folded according to U.S. Pat. Nos. 5,197,659, and 5,273,606 have a considerably lower tendency toward unfolding, due to weakening achieved by the latent destructive lines. An adequately strong and skillful operator, may destructively fold a pizza box, into a log shape, after the box has been opened. However, such a destructively folded box will usually have a larger folded bulkiness, not only after but even before it has been allowed to unfold spontaneously to a degree governed by the characteristics of the individual box.

Thus, according to this invention, there is provided a restrainer in an inactive status to the basic cardboard box structure, which restrainer is adapted to assist the cardboard structure in retaining an as tight as possible position after the cardboard structure has served its purpose and has been destructively folded into a log shaped structure in order to be discarded, and after the restrainer has been activated.

The restrainer may be an integral part of the basic cardboard box structure, it may be a different component attached to the basic cardboard box structure, or it may be detached from said basic cardboard box structure when the restrainer is in the inactive status and being in restraining contact with the box when the restrainer is in the active status, as it will be explained in the description of the different preferred embodiments of the instant invention, hereinbelow.

Referring now to FIG. 1, there is depicted a box-blank 10' as described in U.S. Pat. No. 4,765,534 to Zion et al., which is incorporated herein by reference.

Figure 2:
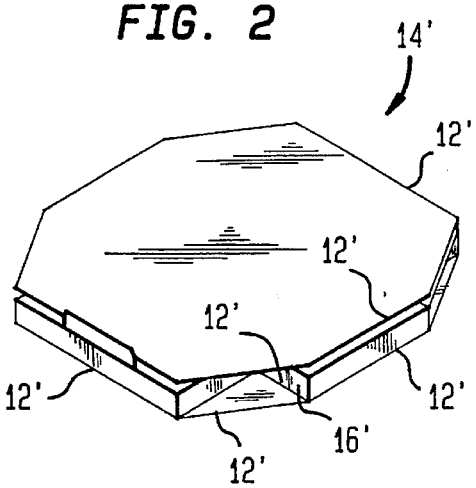
FIG. 2 is a schematic diagram showing a box of the prior art after folding the box blank of FIG. 1 around its primary folding lines.
Figure 3:
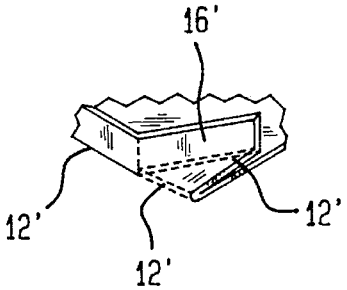
FIG. 3 is a fragmental schematic diagram showing a diagonal wall structure of the prior art.

This type of blank, may be folded by an operator around primary folding lines 12' represented by double-dashed lines to form an octagonal flat container 14', better shown in FIG. 2. This configuration includes diagonal corner wall structures 16', better shown in a fragmental view in FIG. 3, which reinforce the structural characteristics of the container, and they also form a better enclosure, which prevents a pie, such as a pizza pie, from bouncing around when being in the container.

Figure 5:
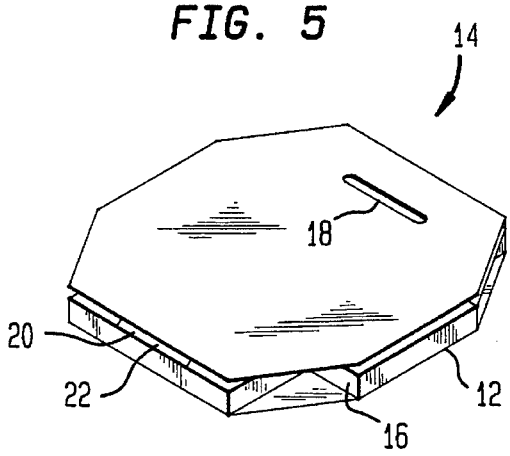
FIG. 5 illustrates a perspective view of a box according to the present invention.
Figure 6:
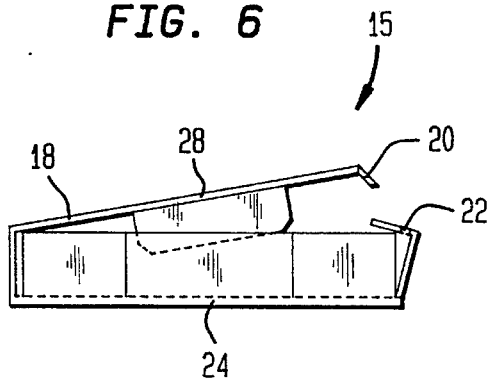
FIG. 6 illustrates a side view of the box of FIG. 5 according to the present invention.
Figure 7:
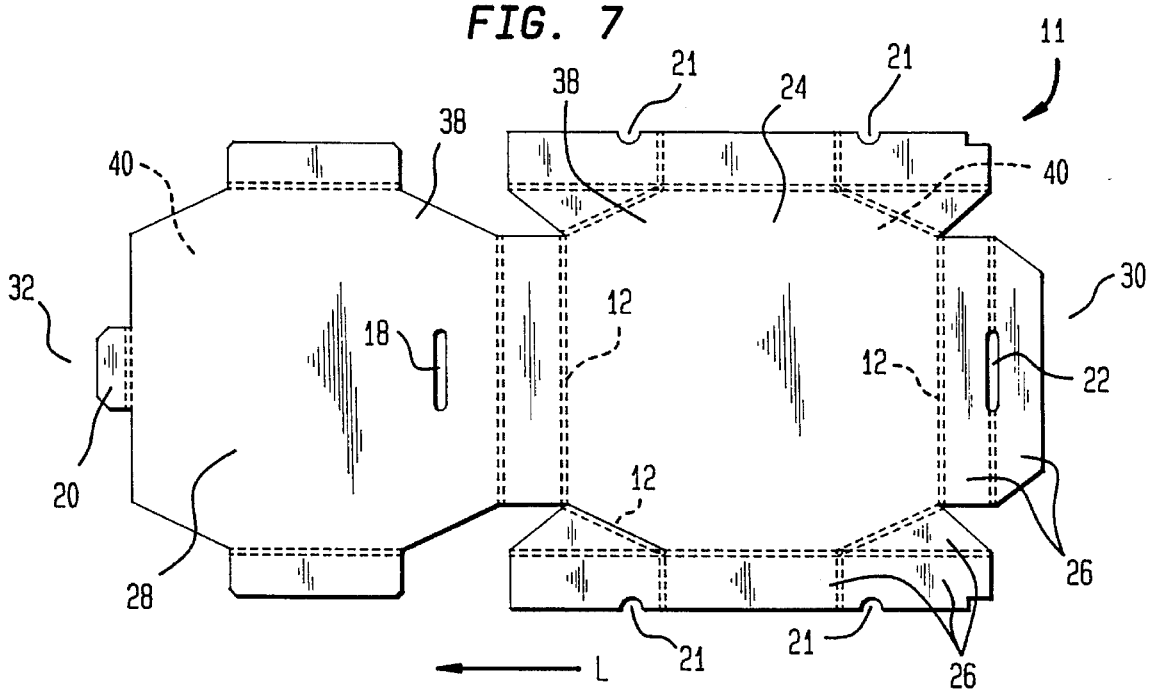
FIG. 7 illustrates a blank of the box of FIGS. 5 and 6 according to the present invention.

According to one embodiment of the present invention, there is provided a box 15 of the type employed to contain an item of the type of a pizza as better illustrated in FIGS. 5, 6, and 7. A completely folded box 15 is shown in FIG. 5, a partially folded box 15 is shown in FIG. 6, and an unfolded box or a box blank 11 is shown in FIG. 7.

Figure 4:
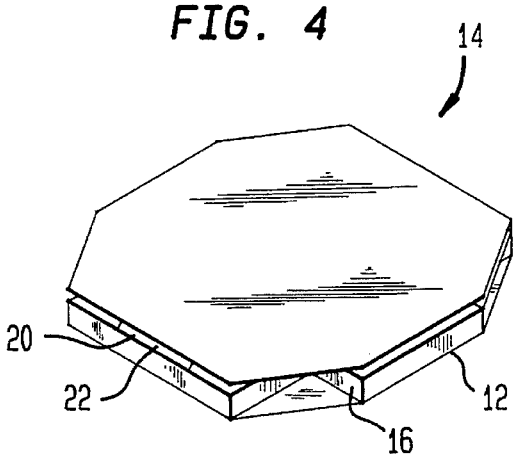
FIG. 4 is a schematic diagram illustrating the basic cardboard structure according to the present invention.

The box 15 (FIGS. 5 and 6) comprises a basic cardboard box structure 14 as illustrated in FIG. 4, which is similar to the container of FIG. 1, comprising folding lines 12 and diagonal corner wall structures 16. The box 15 also comprises a restrainer, which in this particular case is an integral part of the basic cardboard box structure 14 (FIG. 4), thus forming box 15 (FIG. 5). The restrainer comprises an opening 18 and an extension 20 which is adaptable to fit in the opening 18. The extension 20, may also be used to secure the box 15 in a closed position, by an operator inserting the extension 20 into the slot 22 after the blank 11 has been folded to a configuration better shown in FIG. 6.

In operation of this embodiment, an item of the type of a pizza is placed at the bottom 24 of the blank shown in FIG. 7. The sides 26 of the blank 11 are folded toward the item as very well known in the art, and in sequence, the top 28 is also folded on top of the item. When the box 15 has a configuration such as the one shown in FIG. 6, the extension 20 is inserted to the slot 22 for securing the box in a closed position. Of course, the sides 26 may be folded first and then the item be placed over the bottom 24. This part of the operation may be carried out in many other ways well known to the art.

During or before this part of the operation, the restrainer, being in this case the combination of the opening 18 and the extension 20, is said to be in an inactive status, since it does not play an active role.

Figure 8:
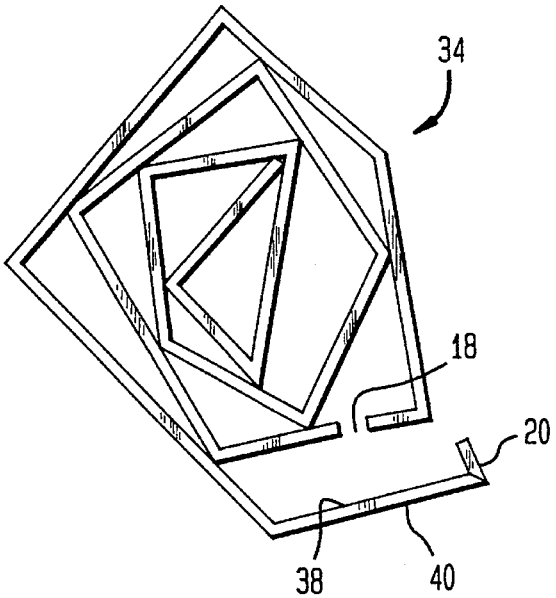
FIG. 8 illustrates a cross sectional view of the box of FIG. 5 after the box has been destructively folded and before activation of the restrainer according to the present invention.

After the box has served its purpose, and it is ready to be discarded, an operator unfolds the box 15 to form a blank 11 again, and then starts destructively folding it in a rolling fashion from the back end 30 toward the front end 32 to form a log-shaped structure, as better shown in FIG. 8.

This, as aforementioned, may need some skill and strength from the operator in the absence of latent destructive lines, since most of these boxes are corrugated, and the corrugations run parallel to the direction L (FIG. 7) of the blank, as they give higher strength when oriented in this direction. Thus, a plurality of latent destructive lines (not shown), perpendicular to the direction L are very desirable, at least at the bottom 24 closer to the end 30 of the re-opened blank 11. The teachings of U.S. Pat. Nos. 5,197,659, and 5,273,606, may be used to design such latent destructive lines.

Figure 9:
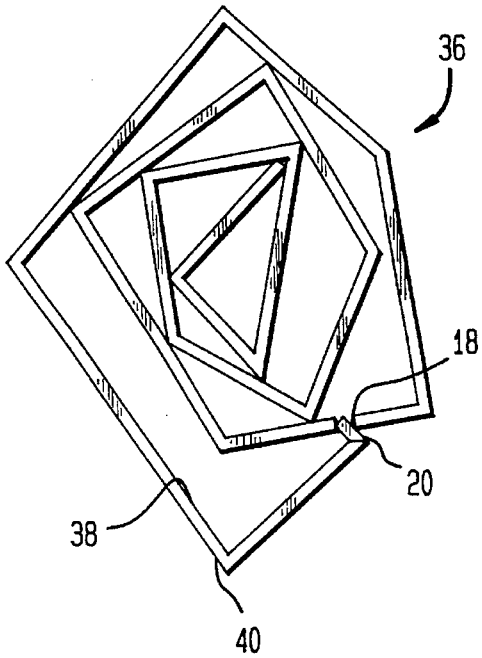
FIG. 9 illustrates a cross sectional view of the box of FIG. 5 after the box has been destructively folded and after the restrainer has been activated, according to the present invention.

After the log-shaped structure 34 has been formed, the extension 20 is inserted into the opening 18 to form a locked log-shaped structure 36, as better shown in FIG. 9. This insertion prevents the locked log-shaped structure from spontaneously unfolding again to a more voluminous configuration. In this configuration, the restrainer, being the combination of the opening 18 and extension 20, is said to be activated, or in an active status. When the restrainer is in an active status or the restrainer has been activated, it prevents spontaneous unfolding of the destructively folded cardboard box structure, or at least it assists said cardboard structure in retaining its destructively folded position.

At this point, the destructively folded box structure is ready to be disposed of, as it has attained a considerably more convenient and stable shape for fitting in a normal garbage can or garbage bag. The log-shaped structures described in U.S. Pat. Nos. 5,197,659, and 5,273,606 offer a definite advantage over the intact boxes. However, the fact that the boxes after being destructively folded have a tendency to spontaneously unfold to a considerable degree, certainly defeats, at least partially, the purpose of destructively folding. In contrast, the locked log-shaped structure of the present invention remains at the folded configuration for easy disposal.

It is preferable that the box is destructively folded in a manner that the inside surfaces (the surfaces which were in contact with the pizza like item) 38 of the box remain as the inside surfaces of the log-shaped structure 34, in a manner that all the outside surfaces 40 of the log-shaped structure 34 remain clean and free of food remainders, as better shown in FIGS. 7, 8 and 9.

The opening 18 is preferably positioned at such distance from the front end 32, so that when the box has been destructively folded or rolled from the back end 30 toward the front end 32 to form a log-shaped structure, the opening finds itself at such position (FIG. 8) that with a slight unfolding, the extension may be inserted into the opening 18 for locking the structure to the configuration illustrated in FIG. 9, or in other words activating the restrainer.

Since different operators may destructively fold the box to different degrees of tightness, an adequate amount of possible over-folding should be allowed in order to decide the positioning of the opening with respect to the extension. The looser the folding and the stronger the box the larger the distance between the opening 18 and the extension 20. This is one additional reason why latent destructive lines are very desirable. Since latent destructive lines may be positioned in a desirable predetermined fashion, and since the destructive folding will take place over these latent destructive lines, a predictable folding pattern will result, so that the positioning of the opening may be determined very accurately, as the degree of destructive folding tightness will be independent of the operator but only dependent on the positioning of the folding lines.

The opening 18 may be also used as a vent to exhaust vapors and steam from the inside of the box when the box contains a hot pie, like a pizza for example. This vent may partially or totally replace vents 21 from sides 25 of the box.

Applicants have found that an excellent way of positioning the latent lines and the opening is according to a technique which they discovered, and which is described in detail in a following embodiment.

Figure 10:
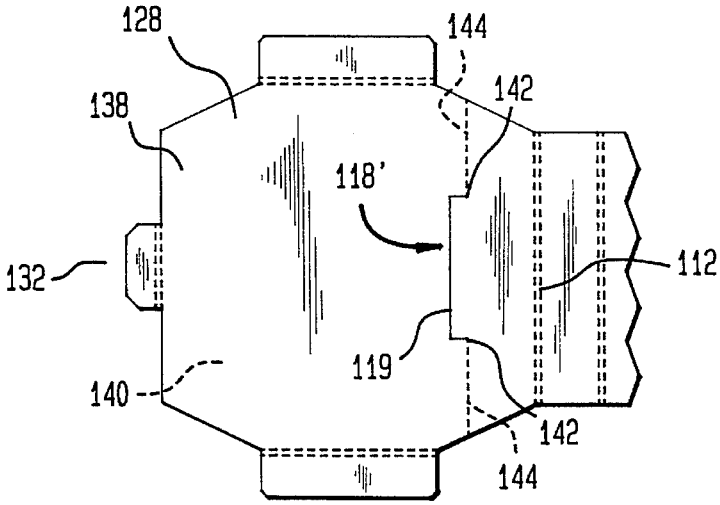
FIG. 10 shows a fractional view of a blank having a latent opening according to the present invention.
Figure 11:
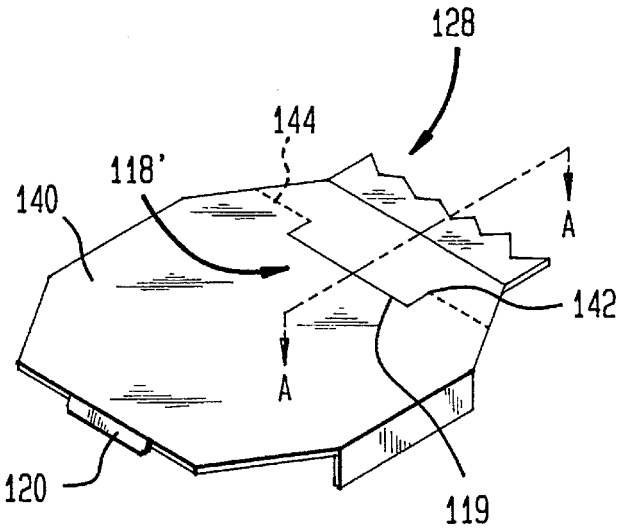
FIG. 11 shows a perspective view of the top of a box corresponding to the blank of FIG. 10, wherein the top comprises a latent opening.
Figure 12:
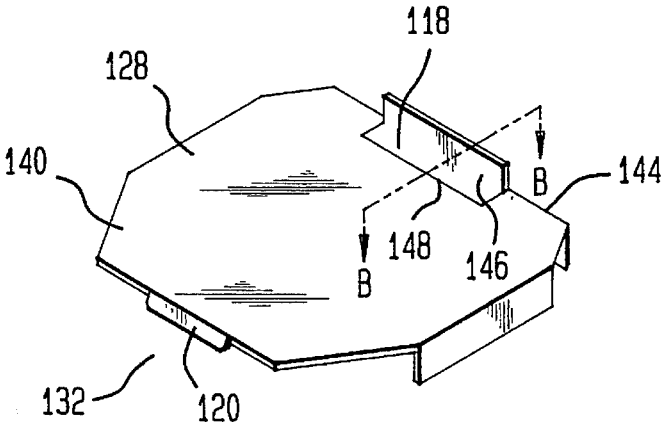
FIG. 12 shows a perspective view of the top of FIG. 11, after the top has been bent around an opening-forming destructive line, and a full opening has been formed.
Figure 13:
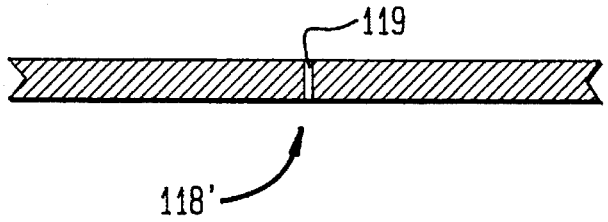
FIG. 13 shows a cross-sectional view of the latent opening of FIG. 11.
Figure 14A:
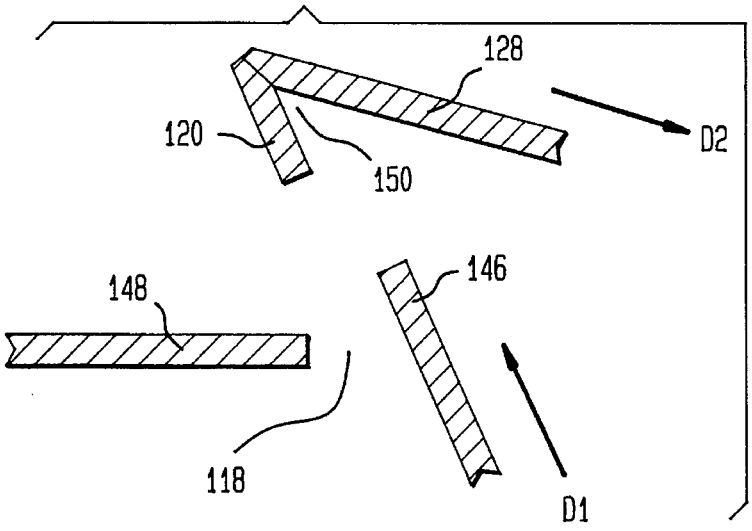
FIG. 14*a* shows a cross-sectional view of the full opening of FIG. 12 along with the extension of the restrainer, after the box has been destructively folded and just before the restrainer has been activated.

In a more preferred embodiment better shown in FIGS. 10 and 11 in a fragmental view, the opening is a latent opening 118' before the box has been destructively folded. The latent opening 118' comprises a cut-through line 119, the width of which is preferably substantially zero. The cut-through line 119 has a "Greek pi" shape. It is important that the ends 142 of the cut-through line 119 are connected to an opening-forming latent destructive line 144, so that when the box is bent or folded around line 144, it attains a configuration as shown in FIG. 12, thus forming a full opening 118. The full opening 118, as better shown in FIG. 12 comprises a tongue 146 on one side. A cross section AA of the part of the top 128 which includes the latent opening 118' of FIG. 11 is better shown in FIG. 13. Similarly, a cross section BB of the part of the top 128 which includes the full opening 118 after the box has been destructively folded around latent destructive line 144 is better shown in FIG. 14*a*. FIG. 14*a* also shows a part of the top 128 with the extension 120 after the box has been destructively folded and the restrainer is ready to be activated, or in other words the extension 120 is in a position ready for insertion into the full opening 118, for holding the box in a log-shaped configuration.

It is critical that the tongue 146 has a direction D1 about opposite to the direction D2 of the tendency of the destructively folded box to spontaneously unfold. This occurs if the tongue 146 is positioned within the angle 150 formed by extension 120 and the top 128 of the box. At the same time, the slit-edge 148 is positioned outside the angle 150 upon insertion of the extension 120 to the opening 118.

Figure 14B:
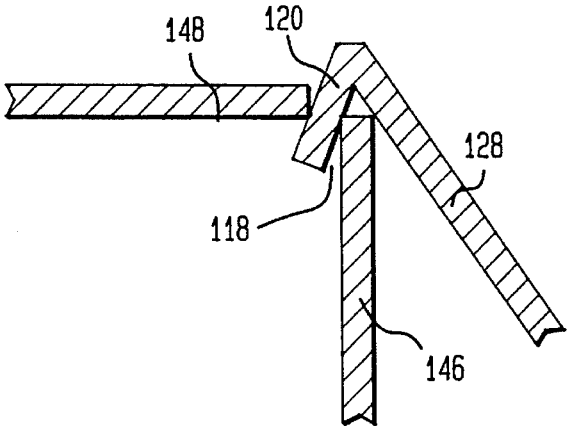
FIG. 14*b* a cross-sectional view of the full opening of FIG. 12 along with the extension of the restrainer, after the box has been destructively folded and after the restrainer has been activated.

It is also very important that the size of the full opening 118 and the size of the extension 120 are such that after the insertion of the extension 120 to the opening 118, and after partial spontaneous unfolding of the box, the extension 120 is jammed by the slit edge 148, as better shown in FIG. 14*b*, in a manner that further unfolding is prevented. Although the extension 120 may also be jammed by other portions of the box if they happen to be in the right place close to the opening 118 upon destructively folding the box, ensuring that the dimensions of the opening 118, the tongue 146, and the extension 120 are adaptable for the slit-edge 148 to jam the extension 120 as shown in FIG. 14*b*, is of great importance for the operation of the system regardless of the way the box may be destructively folded.

In operation of this embodiment, after the box has been used and it is ready for disposal, an operator unfolds the box to its original blank configuration, similar to the one shown in FIG. 7. In sequence, the operator destructively folds the box to a log-shaped structure as in the case of the previous embodiment, he or she ensures that the box has been bent around the latent destructive folding line 144 in order to form the opening 118, and he or she inserts the extension 120 to the opening 118 over the tongue 146, thereby activating the restrainer which prevents the box from spontaneously unfolding. The operator then disposes of the destructively and securely folded box.

Figure 15:
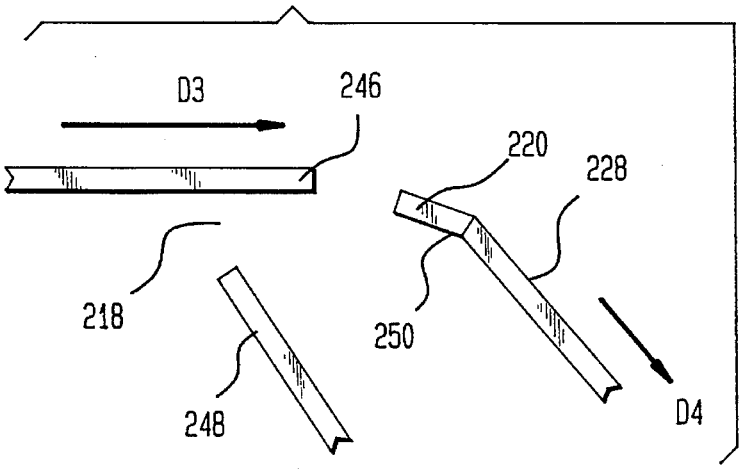
FIG. 15 shows a cross-sectional view of a full opening in a case wherein the direction of the tongue has about the same orientation as the direction of the top of the box.

It is important to note that if the direction D3 of the tongue 246, better shown in FIG. 15, has about the same orientation as the direction D4 of the top 228 of the box, the spontaneous unfolding of the box will not be prevented, since after the extension 220 has been inserted in the opening 218, it will be pulled out again in a sliding motion between the slit-edge 248 and the tongue 246 by the forces involved in the tendency of the box for spontaneous unfolding. One may also observe that in this case, the tongue 246 is positioned outside the angle 250 formed by extension 220 and the top 228 of the box. In contrast, the slit-edge 248 will be within the angle 250 upon insertion of the extension 220 to the opening 218.

Thus, it is critical that the latent opening 118 (see FIGS. **10–14*b*) has such orientation, so that the tongue 146 is positioned within the angle 150 formed by the extension 120 and the top of the box 128 upon insertion of the extension 120 to the opening 118. This condition is fulfilled if the slit edge 148 of the opening 118 is toward the front end 132, while the tongue part 146 of the opening 118 is away from the front end 132**.

In addition to the fact that in most cases after destructive folding it is easier to insert the extension into a full opening having a tongue and the configuration described above than to insert it into a regular opening, the latent opening has the advantage of preventing any contaminant to pass through it and fall onto the contained food item, such as a pizza, for example.

Figure 16:
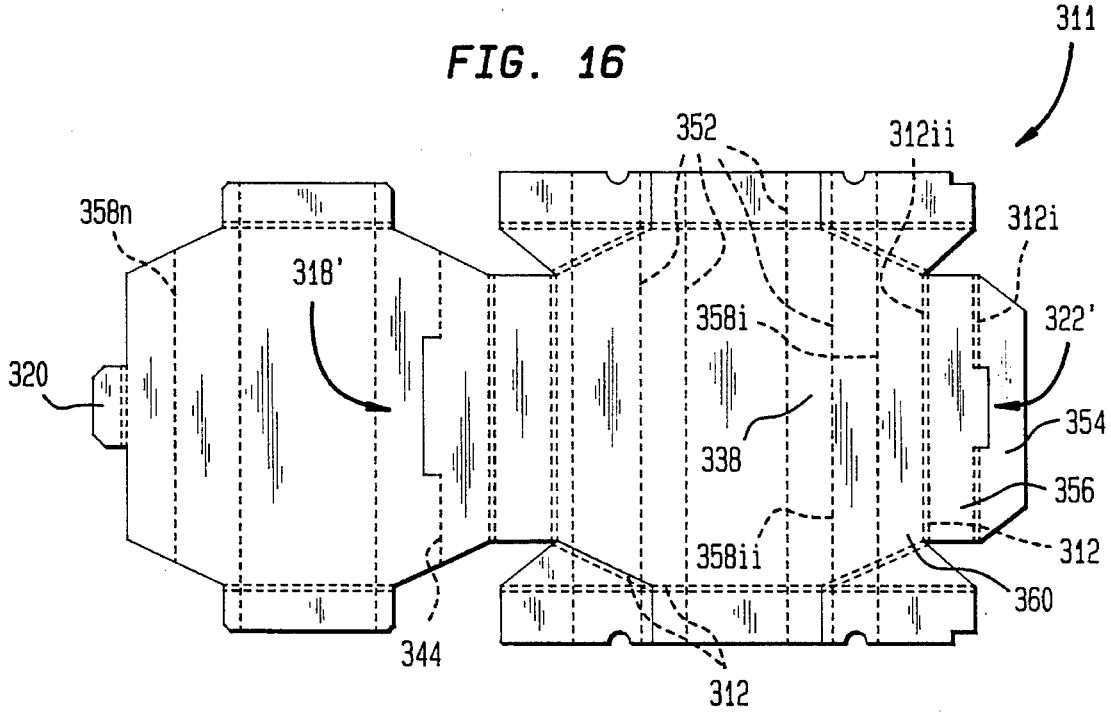
FIG. 16 shows a box blank according to a different embodiment this invention, wherein the blank comprises a latent opening, a latent slot, and latent destructive lines.
Figure 17:
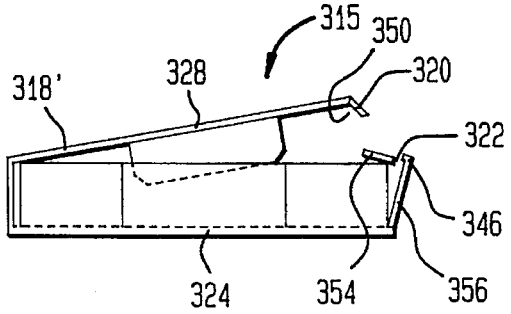
FIG. 17 shows a side view of a box made from the blank of FIG. 16.

In a different embodiment of the present invention, better shown in FIGS. 16 and 17, there is provided a blank 311 having a plurality of latent destructive lines 352 shown by single-dashed lines, in addition to the primary folding lines 312 shown by double-dashed lines. The latent destructive lines have higher resistance to folding than the primary folding lines. Further, in certain occasions it may be important that the resistance toward folding may be different from line to line of the same type, and in particular in the case of latent destructive lines. For example, it is preferable for a box blank to have latent destructive lines of lower resistance to folding in the initial stages of the destructive folding than at the final stages of the destructive folding.

In the same blank 311, there is also depicted the latent opening 318' and the opening forming latent destructive line 344. Also, there is depicted a latent slot 322' which is very similar to the latent opening 318' with the critical difference that the latent slot 322' has an opposite direction than the latent opening 318'. When the box is to be used and closed, the extension 320 is inserted into the fully developed slot 322 (FIG. 17). In contrast with the case of the latent opening 318, as explained above, for the box to close well, it is critical that the tongue 346 of the slot 322 is not included within the angle 350 when the extension 320 is inserted in the slot 322.

The box 315 and its corresponding blank 311 has a first flap 354 and a first side 356. When the first flap 354 is bent by about 90 degrees around the first primary folding line 312', it forms the full slot 322.

An excellent technique to determine good positions for the latent destructive lines has been found by Applicants to be the following:

The box is initially unfolded to assume its blank form, as illustrated in FIG. 16. The first flap 354 is then bent or folded completely around the first primary line **312*i* until it comes in close contact with the first side 356, and forms a first folded combination. The first folded combination is then completely folded again around the second primary folding line 312*ii* until said first folded combination comes in close contact with the inside surface 338 of the blank 311. At this point, a person of ordinary skill in the art can accurately judge where the next folding should be appropriate to be for a further folding operation. At that position, a first latent destructive line 358*i* is made by methods taught in U.S. Pat. Nos. 5,197,659, and 5,273,606. The first latent destructive line 358*i* and the second primary folding line 312*ii* define a first section 360. In sequence, the first folded combination is folded until it comes in close contact with the first section 360*i*, thus forming a second folding combination. The second folding combination is in turn folded around the first latent destructive line 358*i* until it comes in close contact with the inside surface 38 of the blank 311. Again the next folding position can be easily determined by a person of ordinary skill in the art. At that position, a second latent destructive line 358*ii* is made again by methods taught in U.S. Pat. Nos. 5,197,659, and 5,273,606. The same sequence is followed until all latent destructive lines of the box have been formed, including the last latent destructive line 358*n***.

Figure 18:
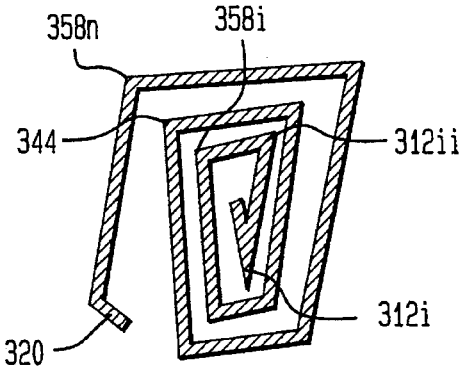
FIG. 18 shows a log shaped structure made after destructively folding the box around its latent destructive lines in order to determine an appropriate position for the latent opening.

The next step is the selection of the position of the latent opening 318'. To determine this, the box blank 311 is completely destructively folded around the first two primary lines **312*i* and 312*ii*, and then around all the latent destructive lines 358*i* to 358*n*, to assume a log-shaped structure, having a cross section similar to the one shown in FIG. 18. The extension 320 is then retracted back in a manner that the log-shaped box starts unfolding until the extension 320 meets the first possible latent destructive line 344 which could accommodate an opening commensurate to the extension and positioned such that it can accept the extension 320. This latent destructive line is then selected as the opening forming latent destructive line 344**.

After the positions of the latent destructive lines and the latent opening have been determined, a die may be made to produce the blanks repeatedly.

The operation of disposing of a box made according to the above method is similar to the operation of the previous embodiment, and no further explanations are needed.

Figure 19:
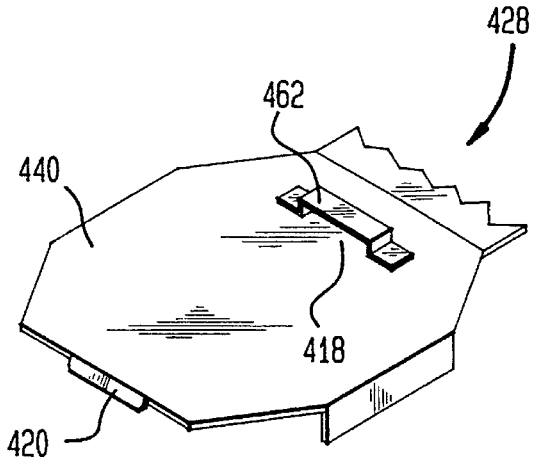
FIG. 19 illustrates a fractional perspective view of a box according to the present invention, having a non-integral opening according to a different embodiment of this invention.

In a different embodiment, better shown in FIG. 19, the restrainer comprises a non-integral opening 418, preferably on the top 428 of the cardboard box structure, and an extension 420 adaptable to fit in the non-integral opening 418, which may be formed between the surface 440 and a bracket 462. The cardboard box structure may further comprise latent folding lines (not shown), the latent lines arranged at such intervals from each other, so that when the cardboard box structure is destructively folded around said latent lines, said cardboard box structure allows the restrainer to be activated by an operator positioning the extension 420 into the opening 418.

The operation of this embodiment is substantially the same as the operation of the previous embodiments.

In still a different embodiment, the restrainer may be attached to the box structure and comprise an element adaptable to tighten the log-shaped structure of the box after the box has been destructively folded. Examples of such elements are band, elastic band, string, cord, strap, tie, ribbon, strand, thread, tape, wire, Velcro™ and a combination thereof, just to mention a few.

Such a restrainer may be attached to the box in any appropriate way, such as for example to be stapled, riveted, pocketed, enclosed, implanted, integrated, consolidated, incorporated, united, taped, bonded, fastened, stuck glued, pasted, cemented, secured, sewed, seamed, stitched, tucked, stuffed, inserted, and the like.

Figure 20:
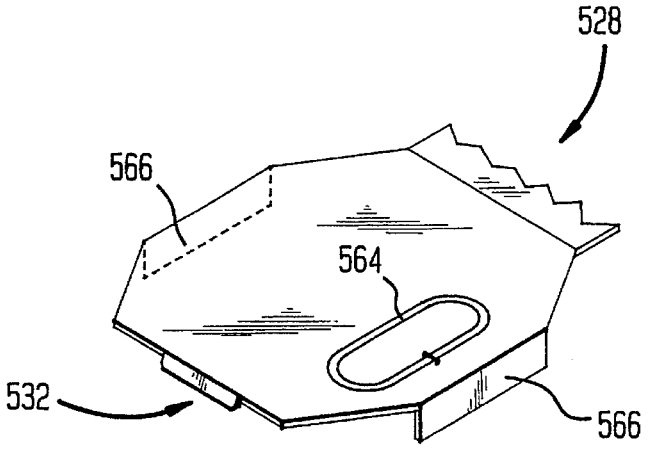
FIG. 20 illustrates a perspective view of the top of a box according to another embodiment of the present invention, on which a restrainer in the form of a rubber band has been attached by stapling.

FIG. 20 illustrates the top 528 of a box according to another embodiment of the present invention, on which a rubber band 564 has been attached by stapling. This rubber band 564 constitutes the restrainer in an inactive form. The operation of this embodiment is very simple. When the box has been used and destructively folded to a log-shaped structure as previously described, the rubber band is forced around the log-shaped structure and prevents it from spontaneously unfolding. At this position, the restrainer is said to be activated or in an active form.

If the rubber band is attached on the top of the box in a manner that would render removal of the band undesirable, it is preferable that such band is positioned within 5 inches from one of the two side sections 566, and within 8 inches from the front end 532.

Figure 21:
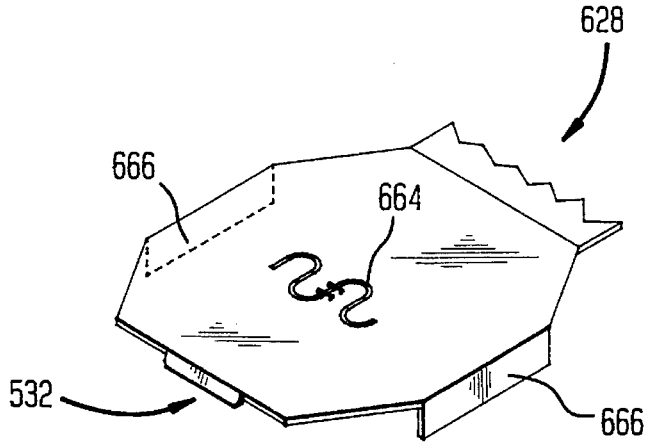
FIG. 21 illustrates a perspective view of the top of a box according to still another embodiment of the present invention, on which a restrainer in the form of a wire or string has been attached by stapling.
Figure 22:
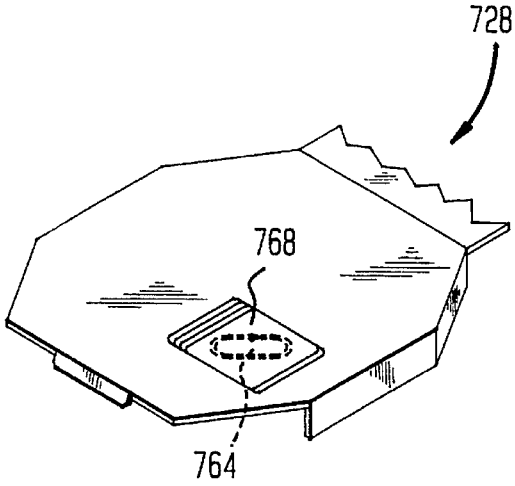
FIG. 22 illustrates a perspective view of the top of a box according to a different embodiment of the present invention, on which a restrainer, such as a rubber band, or string or wire, for example, is kept in an inactive form in a pouch.

FIG. 21 illustrates the top 628 of a box according to still another embodiment of the present invention, on which a wire or string 664 has been attached by stapling. This wire or string constitutes the restrainer in an inactive form. The operation of this embodiment is also very simple. When the box has been used and destructively folded to a log-shaped structure as previously described, the wire or string is tightened around the log-shaped structure and prevents it from spontaneously unfolding. At this position, the restrainer is said to be activated or in an active form.

If the rubber wire or string is attached on the top of the box in a manner that would render removal of the wire or string undesirable, it is preferable that such wire or string is positioned within 8 inches from the front end 632 and in equal distance between the two side sections 666.

In another embodiment, a restrainer 764, such as a rubber band, or string or wire, for example is kept in an inactive form in a pouch 768. The operation of this embodiment is similar to the operation of the other embodiments. The restrainer is taken out of the pouch by an operator and it is tighten around the log shaped structure after the box has been used and destructively folded.

Figure 23:
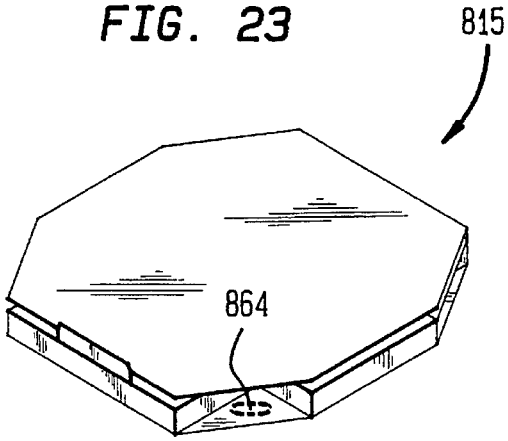
FIG. 23 gives an example of another position, such as the cavity in front of the diagonal wall structure of the box, at which the restrainer in an inactive status may be attached.
Figure 24:
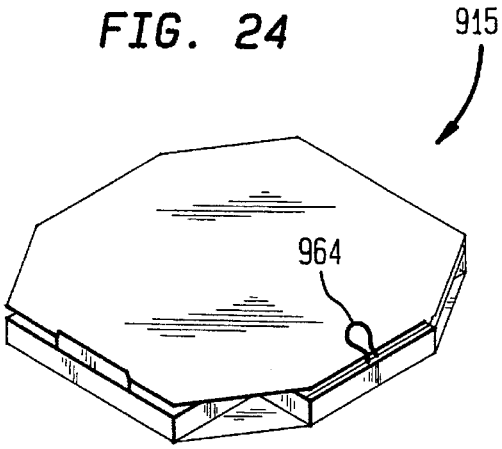
FIG. 24 gives still another example of a different position, such as the space between two adjacent side sections of the box, at which the restrainer in an inactive status may be attached.

FIGS. 23 and 24 give examples of other positions of the boxes 815 and 915, respectively at which the restrainers 864 and 964 may be attached respectively.

The restrainer may also be detached from the box when the restrainer is an inactive status. One example is for the operator to carry the restrainer, such as a rubber band, or a wire, or a string, for example, separately from the box, before the box has been destructively folded, but put it around the log-shaped structure of the destructively folded box and tighten it around the folded box to restrain it from spontaneously unfolding. At this stage, the restrainer is said to be in restraining contact with the destructively folded box.

Although the preferred basic box structure is the one described in U.S. Pat. No. 4,765,534, any other type of box used for items such as pizza pies, which boxes are inconvenient to dispose of may be used within the scope of the instant invention.

It should be understood that examples and embodiments demonstrating the construction, and operation of the instant invention have been given for illustration purposes only, and should not be construed as restricting the scope or limits of this invention in any way. Thus, it is also within the realm of the instant invention to combine features of one embodiment with features of one or more other embodiments resulting in combinations which have not explicitly presented in the exemplification of the present invention.

In the different figures of the drawing, numerals differing by 100 represent elements which are either substantially the same or perform the same function. Therefore, in the case that one element has been defined once in a certain embodiment, its re-definition in other embodiments illustrated in the figures by the same numerals or numerals differing by 100 is not necessary, and it has been often omitted in the above description for purposes of brevity.

What is claimed is:

1. A box assembly comprising:

a cardboard box; and a restrainer in an inactive status, the restrainer being adaptable to assist the cardboard box in retaining a folded position after said cardboard box has been used to hold an item, has been destructively folded to form a log-shaped structure in order to be discarded, and after the restrainer has been activated:

with the requirement that (a) the restrainer comprises an opening and an extension adaptable to fit in the opening, and (b) the cardboard box comprises destructive latent folding lines, the destructive latent folding lines arranged at such intervals from each other, so that when the cardboard box structure is destructively folded around said latent lines, said cardboard box structure allows the restrainer to be activated by an operator positioning the extension into the opening.

2. A box assembly as defined in claim 1, wherein the restrainer is an integral part of the cardboard box structure.

3. A box assembly as defined in claim 2, wherein the opening is a latent opening before the cardboard box has been destructively folded.

4. A box assembly as defined in claim 1, wherein the restrainer comprises a segment forming the opening, the segment being non-integral part of the cardboard box.

5. A box as defined in claim 3, wherein the latent opening is connected to a latent destructive line.

6. A box assembly comprising:

a cardboard box; and a restrainer in an inactive status, the restrainer being adaptable to assist the cardboard box in retaining a folded position after said cardboard box has been used to hold an item, has been destructively folded to form a log-shaped structure in order to be discarded, and after the restrainer has been activated;

with the requirement that (a) the restrainer is an integral part of the cardboard box structure.

(b) the restrainer comprises an opening on the cardboard box and an extension adaptable to fit in the opening, (c) the cardboard box further comprises latent folding lines, the latent lines arranged at such intervals from each other, so that when the cardboard box is destructively folded around said latent lines, said cardboard box allows the restrainer to be activated by an operator positioning the extension into the opening.

7. A combination comprising:

a box assembly and a pie contained in the box assembly the box assembly comprising:

a cardboard box; and a restrainer in an inactive status, the restrainer being adaptable to assist the cardboard box in retaining a folded position after said cardboard box has been used to hold an item, has been destructively folded to form a log-shaped structure in order to be discarded, and after the restrainer has been activated:

with the requirement that (a) the restrainer comprises an opening and an extension adaptable to fit in the opening, and (b) the cardboard box comprises destructive latent folding lines, the distractive latent lines arranged at such intervals from each other, so that when the cardboard box structure is destructively folded around said latent lines, said cardboard box structure allows the restrainer to be activated by an operator positioning the extension into the opening.

8. A combination as defined in claim 7, wherein the restrainer is an integral part of the cardboard box.

9. A combination as defined in claim 7, wherein the restrainer comprises a segment forming the opening, the segment being non-integral part of the cardboard box.

10. A combination as defined in claim 7, wherein the opening is a latent opening before the cardboard box has been destructively folded.

11. A combination comprising:

a box assembly and an item contained within said box assembly:

the box assembly comprising a cardboard box having a front side; and a restrainer in an inactive status, the restrainer being adaptable to assist the cardboard box in retaining a folded position after said cardboard box has been used to hold the item, has been destructively folded to form a log-shaped structure in order to be discarded, and the restrainer has been activated;

with the requirement that the restrainer is an integral part of the cardboard box, comprising an opening on the cardboard box and an extension adaptable to fit in the opening, and the opening is (a) a latent opening before the cardboard box structure has been destructively folded, and (b) connected to a latent destructive line, forming a tongue on a side of the opening away from the front side of the cardboard box, when the cardboard box is destructively folded to the log-shaped structure.

12. A box assembly comprising:

a cardboard box having a front side; and a restrainer in an inactive status, the restrainer being an integral part of the cardboard box, comprising an opening on said cardboard box and an extension adaptable to fit in the opening, and being adaptable to assist the cardboard box in retaining a folded position after said cardboard box has been used to hold an item, has been destructively folded to form a log-shaped structure in order to be discarded, and the restrainer has been activated, with the requirement that the opening is a latent opening before the cardboard box has been destructively folded, and said latent opening forms a tongue on a side of the opening away from the front end of the cardboard box, when the cardboard box is destructively folded to the log-shaped structure.

* * * * *